US007878121B2

(12) United States Patent
Salignon et al.

(10) Patent No.: US 7,878,121 B2
(45) Date of Patent: Feb. 1, 2011

(54) PENETRATION ASSISTING KIT AND METHOD FOR USE

(75) Inventors: Denis Salignon, Orleans (FR); Didier Creusot, Orleans (FR)

(73) Assignee: TDA Armements S.A.S. (FR)

( * ) Notice: Subject to any disclaimer, the term of this patent is extended or adjusted under 35 U.S.C. 154(b) by 0 days.

(21) Appl. No.: 11/917,738

(22) PCT Filed: Jun. 14, 2006

(86) PCT No.: PCT/EP2006/063233

§ 371 (c)(1),
(2), (4) Date: Jul. 9, 2008

(87) PCT Pub. No.: WO2006/134139

PCT Pub. Date: Dec. 21, 2006

(65) Prior Publication Data

US 2008/0314278 A1 Dec. 25, 2008

(30) Foreign Application Priority Data

Jun. 14, 2005 (FR) ..... 05 06016

(51) Int. Cl.
*F42B 12/62* (2006.01)

(52) U.S. Cl. ..... 102/489; 102/383; 102/480

(58) Field of Classification Search ..... 102/372, 102/373, 383, 389, 475, 478, 480, 374, 489
See application file for complete search history.

(56) References Cited

U.S. PATENT DOCUMENTS 1,385,120 A * 7/1921 Ekman ..... 102/383
1,417,299 A * 5/1922 Cahill ..... 102/383
2,264,906 A * 12/1941 Roby ..... 102/383
2,359,192 A * 9/1944 Beblo ..... 102/383
2,428,744 A * 10/1947 Sonnenschein ..... 102/383
3,107,616 A * 10/1963 Boaz et al. ..... 102/480
3,948,175 A * 4/1976 Bucklisch ..... 102/383
4,009,661 A * 3/1977 Dodd ..... 102/480
4,072,107 A * 2/1978 Saxe et al. ..... 102/388
4,172,407 A * 10/1979 Wentink ..... 89/1.56
4,372,216 A 2/1983 Pinson et al.
4,406,209 A * 9/1983 Arene et al. ..... 89/1.701
4,497,253 A 2/1985 Sabranski (Continued)

FOREIGN PATENT DOCUMENTS

EP 1348925 10/2003

(Continued)

*Primary Examiner*—Bret Hayes
(74) *Attorney, Agent, or Firm*—Lowe Hauptman Ham & Berner, LLP

(57) ABSTRACT

The present invention relates to a penetration assistance kit fitted to a bomb, notably an anti-infrastructure bomb. The kit includes launch tubes mechanically secured to the bomb. In each of the launch tubes is positioned a detonating projectile and its propulsive charge. A detonating projectile can be ejected from its tube by initiation of its propulsive charge. A system is provided for controlling the initiation of each propulsive charge prior to impact of the bomb with a target. The invention applies notably to the penetration of very thick walls made of non-metallic material such as concrete, for example. The invention also relates to a penetrating projectile equipped with such a kit and to a method of getting such a projectile to penetrate a target.

13 Claims, 5 Drawing Sheets

U.S. PATENT DOCUMENTS

| | | | | |
|---|---|---|---|---|
| 4,957,046 | A * | 9/1990 | Puttock | 102/489 |
| 5,565,648 | A * | 10/1996 | Lindstadt et al. | 102/478 |
| 5,668,346 | A * | 9/1997 | Kunz et al. | 102/387 |
| 7,017,496 | B2 * | 3/2006 | Lloyd | 102/494 |
| 2003/0122032 | A1 * | 7/2003 | O'Dwyer | 244/3.1 |
| 2004/0055502 | A1 | 3/2004 | Hunn et al. | |
| 2006/0130695 | A1 * | 6/2006 | O'Dwyer | 102/438 |

FOREIGN PATENT DOCUMENTS

| | | |
|---|---|---|
| FR | 1176966 | 4/1959 |

* cited by examiner

PENETRATION ASSISTING KIT AND METHOD FOR USE

CROSS—REFERENCE TO RELATED APPLICATIONS

The present Application is based on International Application No. PCT/EP2006/063233, filed on Jun. 14, 2006, which in turn corresponds to French Application No. 05 06016 filed on Jun. 14, 2005, and priority is hereby claimed under 35 USC §119 based on these applications. Each of these applications are hereby incorporated by reference in their entirety into the present application.

FIELD OF THE INVENTION

The present invention relates to a penetration assistance kit fitted to a bomb, notably an anti-infrastructure bomb. It applies notably to the penetration of very thick walls made of non-metallic materials such as concrete, for example. The invention also relates to a penetrating projectile equipped with such a kit and to a method of getting such a projectile to penetrate a target.

BACKGROUND OF THE INVENTION

It is known practice to produce bombs with high penetration power, particularly to penetrate concrete walls with high rupture modulus in compression. The thickness of such walls may be as much as 1.5 meters or even more. The compression rupture moduli may be of the order of 40 to 45 MPa, and modern-day concretes have compressive rupture moduli way in excess of 100 MPa. The operational requirements to penetrate concrete walls may lead to increasingly high levels of performance of penetration bombs. In particular, these may be required to penetrate increasing thicknesses of concrete walls with increasingly high compressive rupture moduli. Conventionally, the penetration power of a bomb has been dependent upon its kinetic energy. It therefore follows that the greater the difficulties encountered with penetration, as a result of the increase in the thickness of the concrete and/or notably of its strength, the more it becomes logical to increase the kinetic energy of the bomb, for example by altering its mass or its velocity. However, these parameters cannot be improved at will.

SUMMARY OF THE INVENTION

In order to reach its objective, a bomb is carried by a rocket or guidance kit. A rocket is essentially made up of three parts. At the front, it contains its guidance system and at the rear its propulsion motor. Between these two elements lies the warhead charge, or in other words, in essence, the bomb. For reasons of multifunctionality, standardization of launch ramps or standardization of firing posts, the dimensions and weights of rockets are fixed, as is their velocity. It therefore follows that the volume, the weight and the velocity of the bomb are also fixed, irrespective of the performance required. In particular, the kinetic energy cannot be increased with a view to obtaining different, even better, performance.

One solution might be to strengthen the structural integrity of the bomb casing, for example by tripling its thickness. Another solution could alternatively employ a dense material with a significant reduction in diameter. However, these solutions have their drawbacks. The first solution notably prevents the production of a bomb casing that is multifunctional with regard to surface or underground threats. The second solution leads to a bomb casing that is very expensive and, as a result, to a bomb that is highly ineffectual because the mass of explosive that can be carried is therefore reduced by more than half by comparison with a normal steel casing.

It is a notable object of the invention to allow a bomb of relatively poor structural mechanical strength to penetrate increasingly thick or strong walls.

To this end, an objective of the invention is a penetration assistance kit fitted to a bomb, the kit comprising at least:

- launch tubes mechanically secured to the bomb and in each of which is positioned a detonating projectile and its propulsive charge, a detonating projectile being ejected from its tube by initiation of its propulsive charge;
- a system for controlling the initiation of each propulsive charge prior to impact of the bomb with a target.

A launch tube preferably further comprises a counterweight, the explosive charge being positioned between the latter and the detonating projectile so that the counterweight is ejected in the opposite direction to that of the detonating projectile.

The tubes may be fixed to the bomb by means of a first spacer piece positioned at the front of the bomb and of a second spacer piece positioned at the rear of the bomb. To this end, a spacer piece is for example formed of a plate pierced with holes in which the launch tubes are engaged.

The kit preferably comprises an even number of launch tubes, the detonating projectiles being ejected in pairs from two diametrically opposed tubes. The kit for example comprises four launch tubes.

A launch tube comprises, for example, a system for activating the propulsive charge coupled to an external control member. This activation system may advantageously comprise a timer to delay initiation of the explosive charge with respect to a signal supplied by the external control member.

A detonating projectile comprises a system which determines its position inside the target as a function of time and which triggers detonation of its pyrotechnic charge at a predetermined instant. The system determines, for example, the position of the detonating projectile from its characteristics of levels of deceleration in the material of the target and its speed at the point of impact with the target.

Another object of the invention is a penetrating projectile comprising a bomb equipped with a penetration assistance kit as described hereinabove.

A further subject of the invention is a method for getting a bomb equipped with a kit as described hereinabove to penetrate a target, in which:

- a detonating projectile is ejected from its launch tube by initiation of its propulsive charge when the bomb lies at a given distance d from the target;
- a detonating projectile that penetrates the target ahead of the bomb, the projectile detonating inside the target to create an orifice through which the bomb can pass.

The chief advantages of the invention are that it can be fitted to existing bombs, that it enables an increase in the range of angles of attack at which the casing of a bomb reaches a wall, and that it is economical.

BRIEF DESCRIPTION OF THE DRAWINGS

Further features and advantages of the invention will become apparent from the description which follows, given with reference to the attached drawings which depict.

DETAILED DESCRIPTION OF THE DRAWINGS

Figure 1:
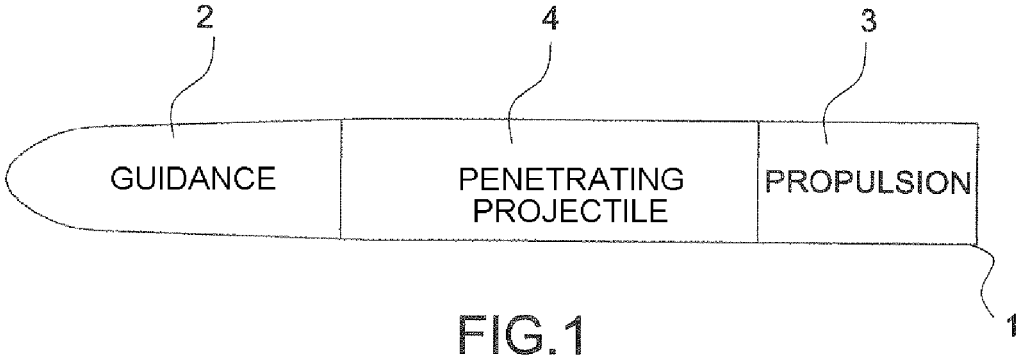
FIG.1 PRIOR ART
FIG. 1, an example of a structure of a rocket.

FIG. 1 depicts the structure of a rocket 1. As mentioned earlier, this rocket is essentially made up of three parts 2, 3, 4. The front of the rocket contains the guidance means 2 and the rear contains the propulsion means 3. Between the two is the penetrating projectile 4, for example a warhead charge such as a bomb. The fact that the rocket envelope is fixed as is its overall mass, means that the volume and mass given over to the penetrating projectile 4 are themselves also fixed, insofar as it is barely possible in any case to reduce the sections given over to the guidance means and to the propulsion means. The structural mechanical strength of the penetrating casing cannot therefore be appreciably improved. Likewise, the velocity of the penetrating casing is set by the velocity of the rocket 1.

Figure 2:
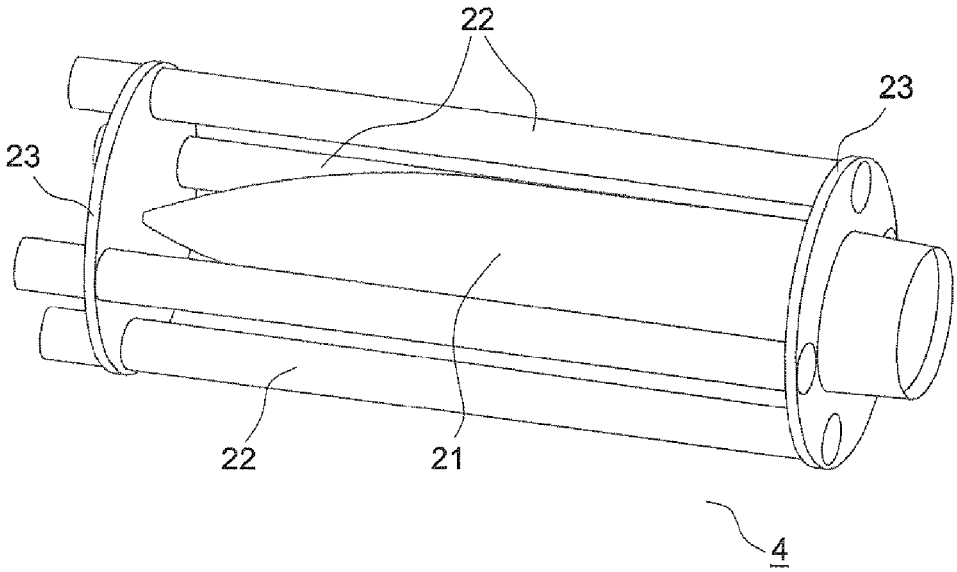
FIG. 2, one possible exemplary embodiment of a projectile according to the invention fitted with a penetration assistance kit.

FIG. 2 shows a penetrating projectile according to the invention, more particularly a bomb 21 equipped with a penetration assistance kit. The penetrating projectile 4 is, for example, positioned in a rocket 1 according to FIG. 1. The kit comprises launch tubes 22. A launch tube comprises a hypervelocity detonating projectile which is triggered close to a target, before the penetrating bomb 21 reaches this target. This hypervelocity detonating projectile is in fact intended to reach the target before the bomb 21 arrives, to penetrate the target and destroy it by detonating within it.

The launch tubes 22 are mechanically secured to the bomb 21. To do this, the kit comprises for example spacer pieces 23. A spacer piece is formed for example of a disk or a plate, pierced with holes in which the launch tubes are engaged. These tubes may be fixed to the spacer piece by means of spot welds. A first spacer piece 23 is positioned forward of the bomb 21. It can then be screwed or welded onto the front of the bomb. A second spacer piece is positioned behind the bomb. It is, for example, pierced at its center in order to fit around the casing of the bomb. It may be held in place by spot welds. The material of which the launch tubes 22 are made is, for example, stainless steel. The spacer pieces 23 are, for example, made of aluminum or plastic.

The dimensions of the launch tubes 22 and of the spacer pieces 23 are notably designed so that the assembly made up of the bomb and of the kit can fit into an operational space, for example the space provided in the rocket 1 to accommodate a penetrating projectile 4. By way of example, the penetration assistance kit depicted in FIG. 2 comprises four launch tubes. It may obviously have a different number of these, according in particular to the size.

Figure 3:
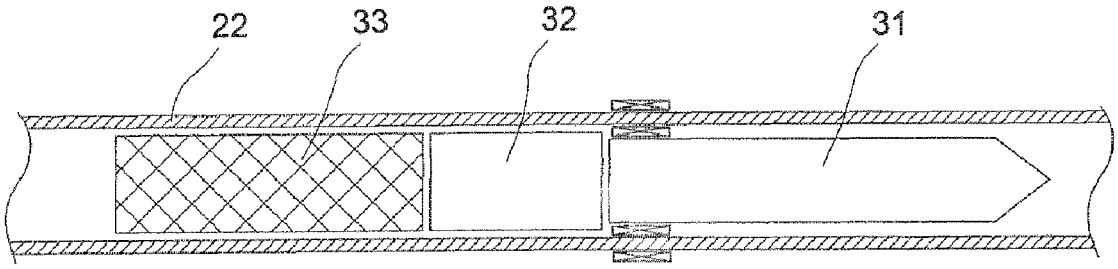
FIG. 3, in a partial view, one exemplary embodiment of a kit according to the invention fitted to a penetration bomb.

FIG. 3 shows an exemplary embodiment of a penetration assistance kit and more specifically shows the possible content of a launch tube 22. The launch tube is represented in a partial view in longitudinal section. The elements it contains are symbolized by the locations that they occupy. Thus, the launch tube 22 comprises a hypervelocity detonating projectile 31 and a propulsive charge 32. The detonating projectile 31 is ejected from the tube when the propulsive charge is activated. The detonating projectile 31 is then ejected from the tube 22 with a speed markedly higher than the speed of the latter and therefore markedly higher than the speed of the penetration bomb 21 which remains securely in the tube. A tube 22 comprises a system for activating the propulsive charge 32 coupled to an external control member. As will be indicated hereinafter, this external control member may be installed in the bomb 21 or in the rocket 1.

In order to avoid any imbalance liable to have an adverse effect on the trajectory of the assembly that forms the penetrating projectile, the launcher 22 also for example comprises a counterweight 33, the propulsive charge 32 being positioned between this counterweight 33 and the detonating projectile 31. Thus, when the propulsive charge 32 is activated, the detonating projectile 31 will be propelled toward the front of the bomb 21, whereas the counterweight 33 will be propelled toward the rear of the bomb.

If the penetration assistance kit comprises, for example, four tubes 22 so equipped, the arrival of the penetrating bomb 21 at a target will be preceded by four impacts effected by the four detonating projectiles 31 ejected from the tubes 22.

For preference, the detonating projectiles 31 are ejected at substantially the same instant, although this is not compulsory. If the projectiles 31 are not all triggered at the same instant, they are preferably ejected at the same time in pairs, the two projectiles then ejected being symmetric with respect to the axis of the penetrating bomb 21 in order to avoid imbalance. It is then necessary to transmit an ejection triggering command to the tubes 22.

Figure 4:
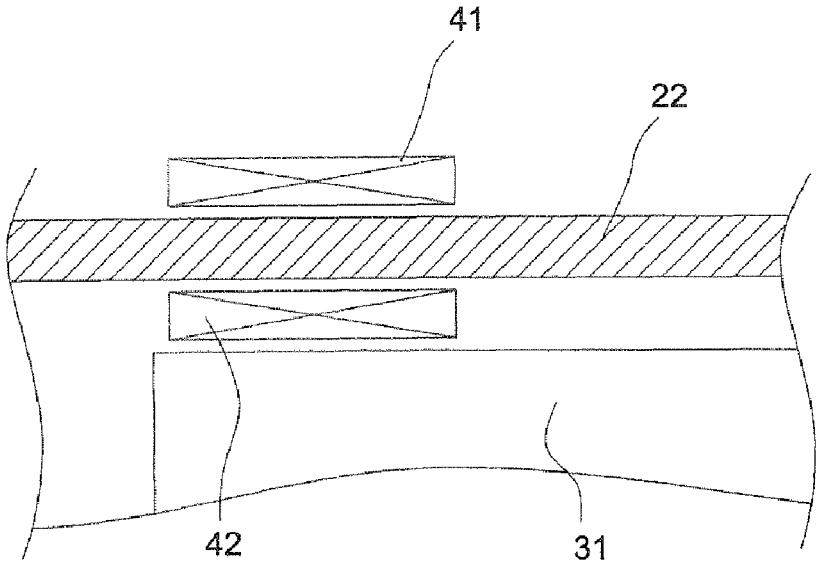
FIG. 4, one exemplary embodiment of an activation device of a kit according to the invention.

FIG. 4 shows, in a partial view in cross section, one exemplary embodiment of a device for transmitting an activation signal to a launch tube 22. This activation signal comes from outside the launch tube 22. It may be generated by the rocket 1, for example its guidance means 2. It may also be generated by the penetrating bomb 21. It is necessary in fact for the signal to be transmitted early enough to activate the propulsive charge 32 and eject the detonating projectile 31 before the bomb 21 arrives at the target. It is necessary to envision ejection a given distance away from the target. The activation signal is transmitted for example by induction. To do this, the tube 22 comprises a first coil 41, wound onto its exterior surface, and a second coil 42, positioned facing the first coil but inside the tube. The signal thus transmitted via the coils 41, 42 is then directed into the tube to the propulsive charge activation means. The signal may possibly be transmitted via a timer circuit. This may notably be of use if the signal is transmitted by the rocket. In such a case, when the rocket detects a first distance to the target, it ejects the penetrating projectile, that is to say the assembly made up of the bomb 21 and of the kit 22, 23. Upon detection of this first ejection distance, the rocket also sends an activation signal to the launchers. Ejection of the detonating projectiles 31 therefore occurs after a time $\Delta t_0$ defined by the timer circuit. To supplement transmission of the activation signal, the external coil is, for example, connected by an electric wire to the rocket via, for example, the spacer pieces which may have interconnection printed circuits and the signal may therefore be transmitted from the spacer pieces to the coils 41, 42 by a metal braid fixed to the tube.

Figure 5:
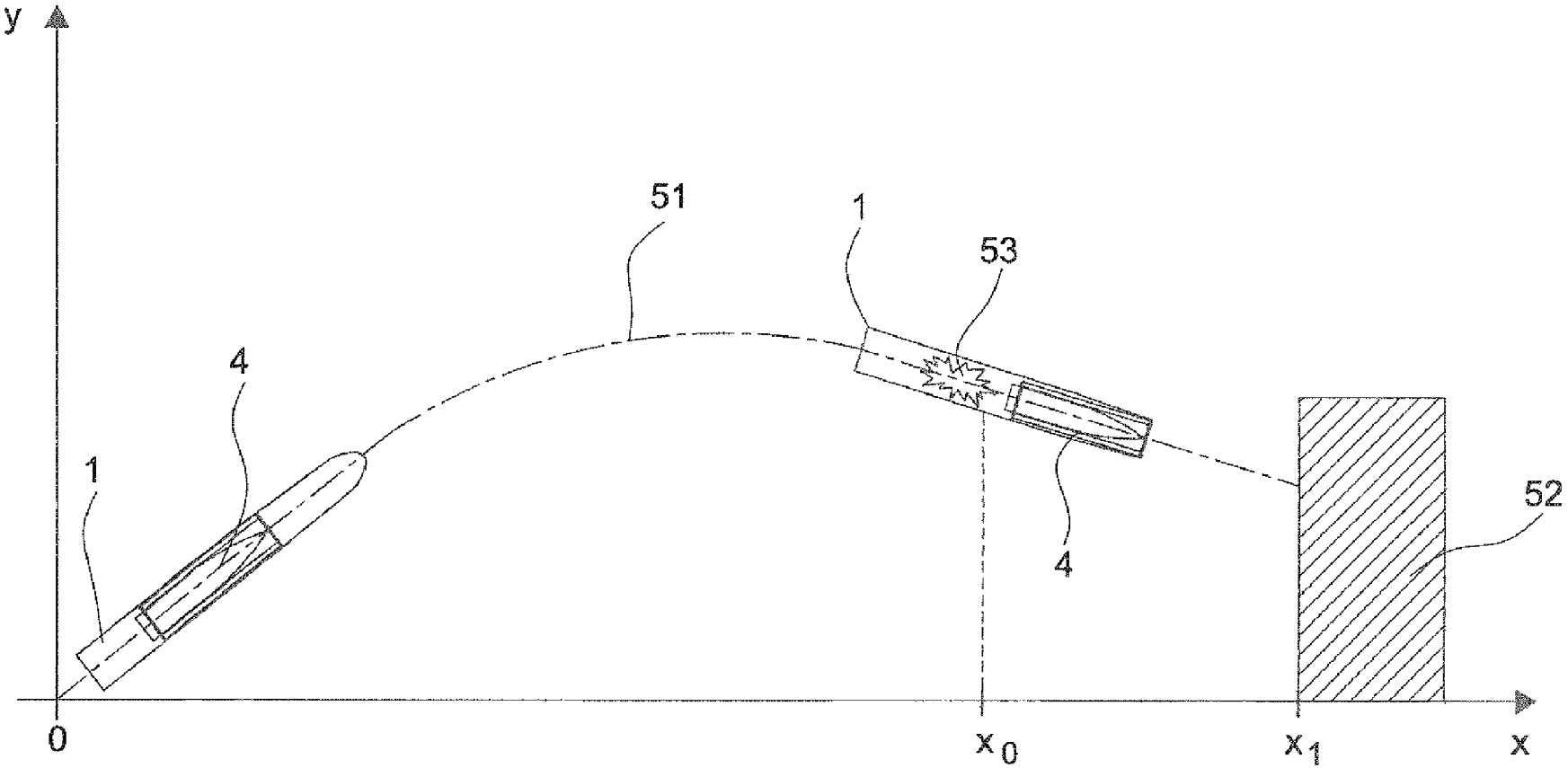
FIG. 5, the situation of a rocket containing a penetrating projectile according to the invention at the time of launch of the rocket and upon ejection of the projectile from the rocket.

FIG. 5 shows the rocket 1 at two points on its trajectory 51 toward a concrete wall 52 in an x, y axes system. The positions relative to the ground are given on an abscissa axis x. The ordinate axis y represents the altitude of the rocket. For ease of depiction, the distances and altitudes are drawn to a smaller scale than the scale at which the rocket and the concrete slab have been depicted. In the starting position, abscissa value 0, the rocket fitted with its penetrating projectile 4 is positioned with a view to launching. The penetration projectile 4 is made up of the bomb 21 and of its penetration assistance kit 22, 23. The concrete wall lies a distance $x_1$ away from the starting position. The rocket is propelled by its propulsion means 3 situated at the rear. The position of the rocket with respect to the wall 52 is determined for example by a proximity sensor situated at the front of the rocket with the guidance means. Hence, when this proximity sensor detects the distance $x_1$-$x_0$, it also sends an activation signal to the launch tubes 22 which will then trigger ejection of the detonating projectiles after the aforementioned time delay $\Delta t_0$.

FIGS. 6*a* to 6*f* illustrate the method of the invention by showing the various phases of a penetrating projectile according to the invention in the approach phase and the phase in which it penetrates the wall 52. These figures notably illustrate the penetration assistance afforded by a kit according to the invention. The kit comprises a system that allows each propulsive charge to be initiated prior to impact of the bomb 21 with the target, the wall 52 in the case of FIGS. 6*a* to 6*f*. This system can be centralized, positioned for example in the safety or firing device, on a spacer piece 23 or decentralized into the tubes.

Figures 6A, 6B, 6C, 6D, 6E, 6F:
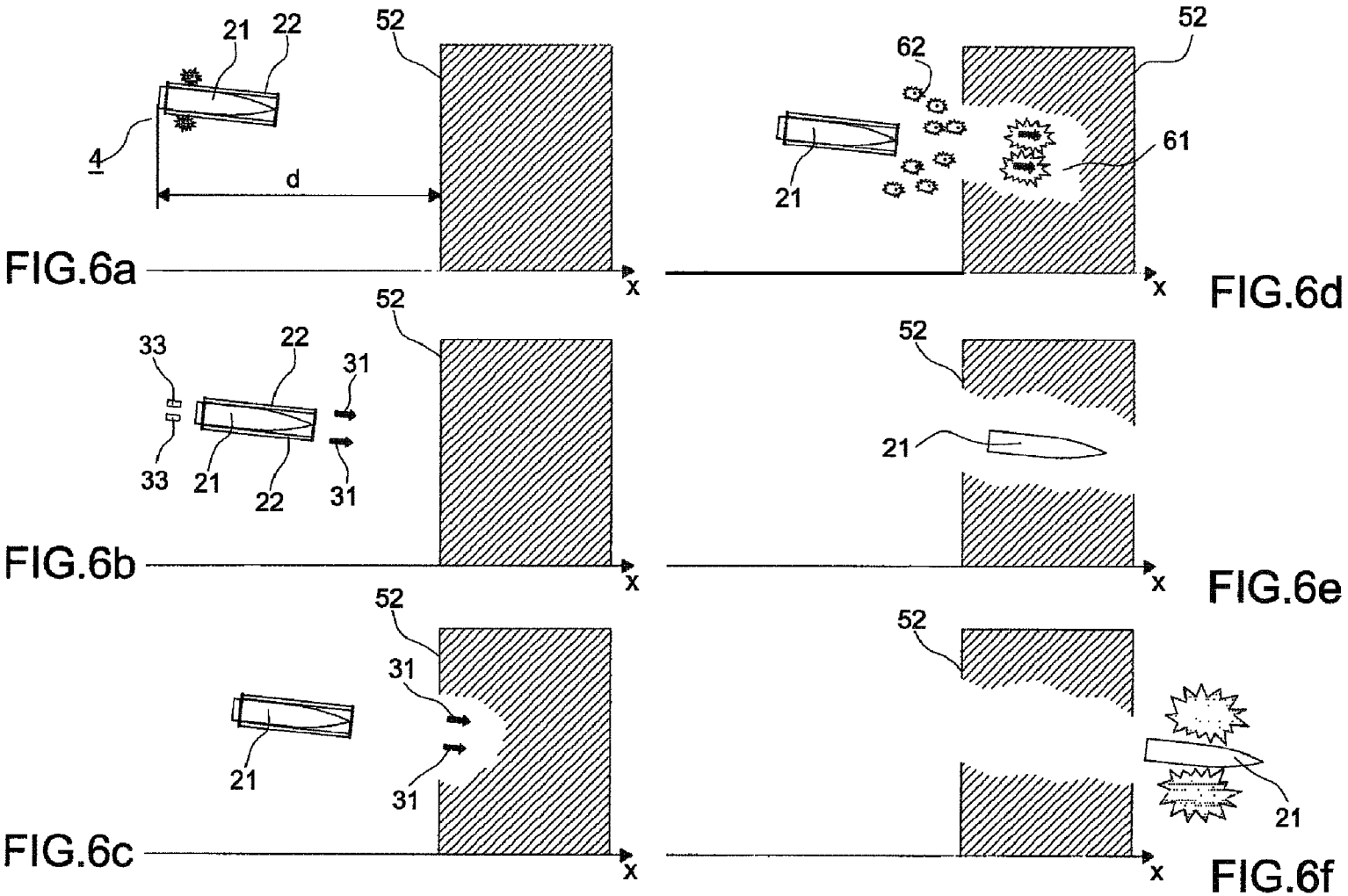
FIGS. 6*a* to 6*f*, an illustration of the use of a kit according to the invention to assist the penetration of an anti-infrastructure bomb.

FIG. 6*a* shows the instant of initiation of the propulsive charges 32 on immediate approach of the target, in this instance the wall 52. Initiation of these propulsive charges initializes the ejection of the detonating projectiles 31 from the launch tubes 22. At this instant, the bomb 21 equipped with its kit is a distance d away, d being shorter than the distance $x_1$-$x_0$. This distance d is, for example, of the order of 10 meters. The distances $x_1$-$x_0$ and d may possibly be substantially the same. At the moment of initiation, each detonating projectile 31 is therefore ejected from its tube 22 at a very high velocity relative to this tube. By way of example, if the bomb 21 is traveling at a velocity of the order of 300 m/s, each detonating projectile 31 may exit at a relative velocity of this order. This results in an absolute velocity with respect to the wall of the order of 600 to 700 m/s for example. There are several possible ways of determining the moment of initiation of the propulsive charges 32, that is to say the moment of ejection of a detonating projectile from its launch tube 22. As already indicated, a timer positioned for example in an electronic circuit associated with the tube 22 may, for example, calculate a delay between the moment of ejection of the bomb casing 21 from the rocket 1 and the moment of initiation of the propulsive charge 32 within the tube, the moment of ejection of the bomb casing itself being determined for example by the guidance means 2 situated in the front of the rocket 1. Knowing the velocity of the bomb casing and the distance $x_1$-$x_0$ from the latter to the wall at the moment of initiation, it is then possible to determine the duration of the time delay in order for the detonating projectile 31 to be ejected at substantially the desired distance d away from the wall.

FIG. 6*b* shows the flight of the detonating projectiles 31 as far as the wall 52, followed by the bomb casing 21. The detonating projectiles 31 therefore travel toward the target at a velocity so much higher than the velocity of the bomb 21. In order not to cause the bomb 21 to lose speed in parallel with the ejection of the detonating projectiles 31 toward the front of the bomb 21, the counterweights 33 are ejected to the rear. The counterweight 33 is sized in such a way that the rearward momentum is substantially the same as the forward momentum. To achieve this, a counterweight 33 may have a mass equivalent to that of the detonating projectile 31.

FIG. 6*c* shows the penetration of the detonating projectiles 31 into the wall 52 before the bomb 21 arrives at the wall.

FIG. 6*d* shows the detonation of the detonating projectile 31 within the wall, preferably in the middle, creating an orifice 61 which, if possible, passes through the wall 52. To do this, each detonating projectile comprises, for example, a system which determines its position within the wall as a function of time and which initiates detonation of its pyrotechnic charge at a predetermined instant.

The invention advantageously makes use of the fact that concretes are not very good at withstanding tensile stresses. This allows them to be destroyed relatively easily by detonating of a projectile 31 within the wall, this internal detonation creating high tensile stresses. An internal processor situated, for example, inside the projectile 31 is able to determine its moment of detonation to correspond to its most effective position within the wall, for example in the middle thereof. To do this, a table is for example stored in memory in the processor. This table contains the characteristics of the levels of deceleration of an object penetrating a material. It is able to take account of several types of material including, of course, concrete, and even different types of concrete. Thus, with knowledge of the initial velocity of the projectile 31 upon entering the wall, at the point of impact, and the deceleration curve for the material of this wall, it is possible to determine the distance penetrated within the wall as a function of time and therefore position. An impact intelligence module of the "caimam" type is for example used.

FIG. 6*e* shows the penetration of the bomb casing 21 into the orifice 61 created by the projectiles 31. On penetrating the wall 52 the kit for example becomes detached from the bomb.

The detonation of the projectiles 31, for example in the middle of the wall 52, creates this orifice 61. The amount of charge transferred by the projectiles 31 can be calculated to obtain an orifice tailored to the caliber of the bomb casing 21, that is to say, in practice, close to the caliber of the bomb casing.

The invention thus makes it possible considerably to reduce the stresses experienced by the bomb casing during its phase of penetrating the wall and thereby allows a bomb of relatively low structural mechanical strength to penetrate walls of increasing thickness or strength. By reducing the strength of the mechanical structure of the bomb casing it then becomes possible to increase the mass of explosive carried hence yielding a greater destructive power once the wall has been penetrated. Thus, it becomes possible for example to increase the mass of explosive carried by about 20%, this leading to a fragment mass and velocity which are increased by 15% for example.

FIG. 6*f* shows the bomb casing 21 after the wall 52 has been reached. At this moment, the bomb casing may, for example, detonate by initiation of its pyrotechnic charge.

Figure 7:
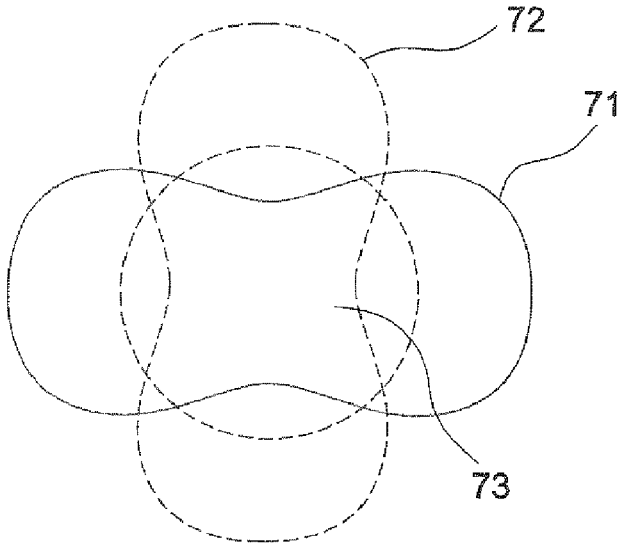
FIG. 7, an illustration of the impact achieved by detonating projectiles contained in a kit according to the invention.

FIG. 7 illustrates the impacts created by the detonating projectiles 31 inside the wall 52 when the penetration assistance kit comprises four launch tubes 22, each one equipped with a detonating projectile 31. A first impact 71 is created by a first detonation produced by two projectiles from two diametrically opposed launchers. A second impact 72 is created by a second detonation produced by the projectiles from the other two diametrically opposed launchers. The axes of symmetry of these two impacts 71, 72 are substantially perpendicular. The combination of these two impacts results in a substantially circular impact 73 creating an orifice that allows the bomb 21 to penetrate the wall. The diameter of the circular impact 73 may reach a diameter of the order of one meter.

Figure 8:
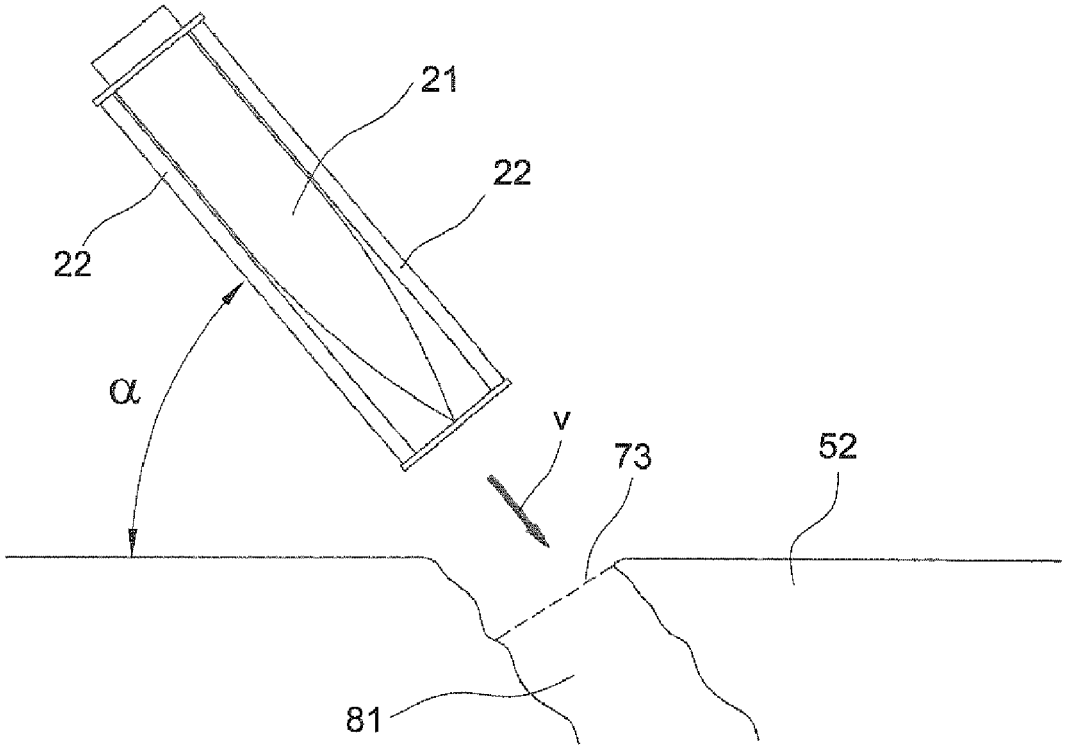
FIG. 8, an illustration of the broad range of angles of attack of a projectile according to the invention against a wall.

FIG. 8 illustrates another advantage of the invention. In particular, this figure shows that the invention makes it possible to increase the range of angles of attack of the bomb casing 21 arriving at a wall 52. The orifice 81 created by the projectiles 31 in the wall 52 thereby creates an entry face 73 normal to the velocity vector V of the bomb casing. This entry face 73 in particular prevents the bomb casing from ricocheting off the wall when the angle of attack $\alpha$ of its velocity vector with respect to the wall is too shallow. If this angle $\alpha$ is, in spite of everything, far too shallow, there will nonetheless be some attack. A projectile 31 which is more slender and more fast-moving than the bomb casing can penetrate the wall even at shallow angles of attack, the bomb casing benefiting from the orifice created by the detonating projectiles and thereby having a wider range of angle of attack.

The invention has been described for the embodiment of a bomb intended to penetrate the interior of an infrastructure. Nonetheless, it can be applied to other types of projectiles intended to penetrate an infrastructure by penetrating a thick wall. The invention in particular makes it possible to penetrate concrete walls with high compression rupture moduli of 50 or even 60 MPa, for example.

The notable advantages of the invention are that it can be adapted to suit any existing type of bomb, all that is required being for these existing bombs to be fitted with a penetration assistance kit in order to increase their penetration power. The invention is also economical notably because of the ease with which the kit can be adapted without the need to develop a new type of bomb.

The invention claimed is:

1. A penetration assistance kit fitted to a bomb, comprising:
launch tubes adapted to be mechanically securable to a bomb and each of said launch tubes comprising
a detonating projectile; and
a propulsive charge,
wherein said detonating projectile is ejected from a respective launch tube, towards a target of the bomb, by an initiation of a respective propulsive charge;
a system for controlling the initiation of each said propulsive charge prior to an impact of the bomb with the target,
wherein
each of said launch tubes further comprises a counterweight,
the propulsive charge is positioned between the counterweight and the detonating projectile, and
the counterweight is ejected opposite to the detonating projectile.

2. The kit as claimed in claim 1, wherein the launch tubes are adapted to be fixed to the bomb by a first spacer piece positioned at the front of the bomb and a second spacer piece positioned at the rear of the bomb.

3. The kit as claimed in claim 2, wherein said first spacer piece or said second spacer piece is formed of a plate including through-holes in which the launch tubes are engaged.

4. The kit as claimed in claim 1, wherein each of said launch tubes further comprises an activation system for activating the propulsive charge, and the propulsive charge is coupled to an external control member.

5. The kit as claimed in claim 4, wherein the activation system comprises a timer to delay the initiation of the propulsive charge with respect to a signal supplied by the external control member.

6. The kit as claimed in claim 1, wherein said detonating projectile comprises a system which determines a position of the detonating projectile inside the target as a function of time, and triggers a detonation of a pyrotechnic charge at a predetermined instant.

7. The kit as claimed in claim 6, wherein the system determines the position of the detonating projectile from its characteristics of levels of deceleration in the material of the target and its speed at a point of the impact with the target.

8. The kit as claimed in claim 1, wherein the launch tubes are provided at an even number, and the detonating projectiles are ejected in pairs from two diametrically opposed tubes.

9. The kit as claimed in claim 1, wherein the kit comprises four launch tubes.

10. A penetrating projectile, comprising:
a bomb equipped with a kit, wherein said kit comprises
launch tubes mechanically securable to the bomb and each of said launch tubes comprising
a detonating projectile; and
a propulsive charge,
wherein said detonating projectile is ejected from a respective launch tube, towards a target of the bomb, by an initiation of a respective propulsive charge;
a system for controlling the initiation of each said propulsive charge prior to impact of the bomb with the target,
wherein
each of said launch tubes further comprises a counterweight,
the propulsive charge is positioned between the counterweight and the detonating projectile, and
the counterweight is ejected opposite to the detonating projectile.

11. A method for getting a bomb equipped with a kit as claimed in claim 1 to penetrate a target, comprising:
ejecting the detonating projectile from the respective launch tube towards the target by an initiation of the respective propulsive charge when the bomb lies at a given distance from the target;
penetrating the target ahead of the bomb by the detonating projectile;
detonating the projectile inside the target; and
creating an orifice through which the bomb can pass.

12. The method as claimed in claim 11, wherein the detonating projectile detonates in a middle of the target.

13. The method as claimed in claim 11, wherein the target is a concrete wall.

* * * * *